US011213843B2

(12) United States Patent
Baumann

(10) Patent No.: US 11,213,843 B2
(45) Date of Patent: Jan. 4, 2022

(54) LIQUID DISPENSER WITH VENTILATED BOTTLE AND DISCHARGE HEAD FOR THIS PURPOSE

(71) Applicant: Aptar Radolfzell GmbH, Radolfzell (DE)

(72) Inventor: Tobias Baumann, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 16/629,135

(22) PCT Filed: Jun. 21, 2018

(86) PCT No.: PCT/EP2018/066685

§ 371 (c)(1),
(2) Date: Jan. 7, 2020

(87) PCT Pub. No.: WO2019/011621

PCT Pub. Date: Jan. 17, 2019

(65) Prior Publication Data

US 2020/0130002 A1 Apr. 30, 2020

(30) Foreign Application Priority Data

Jul. 13, 2017 (EP) ..... 17181284

(51) Int. Cl.
*B05B 11/00* (2006.01)

(52) U.S. Cl.
CPC ..... *B05B 11/3035* (2013.01); *B05B 11/0044* (2018.08); *B05B 11/3033* (2013.01)

(58) Field of Classification Search
CPC ..... B05B 11/3035; B05B 11/0044; B05B 11/3033
See application file for complete search history.

(56) References Cited

U.S. PATENT DOCUMENTS 4,235,344 A 11/1980 Kulle et al.
5,310,094 A * 5/1994 Martinez ..... B05B 11/0075 222/212

(Continued)

FOREIGN PATENT DOCUMENTS

CN 87104268 A 12/1987
CN 101014417 A 8/2007

(Continued)

OTHER PUBLICATIONS

International Search Report issued in Application No. PCT/EP2018/066685 dated Aug. 24, 2018 and English translation (7 pages).

(Continued)

*Primary Examiner* — Jeremy Carroll
(74) *Attorney, Agent, or Firm* — Flynn Thiel, P.C.

(57) ABSTRACT

A discharge head for a liquid dispenser having a coupling device fastening to an outlet connector of a liquid store, a liquid inlet, and a discharge opening. The discharge head has a pump device conveying liquid from the liquid inlet to the discharge opening, and a ventilation channel. The discharge head has an end surface by which the liquid store is substantially closed off at the distal end of the outlet connector and which is extended through by the liquid inlet. The end surface and the coupling device are formed as part of a common main component. The end surface has a ventilation aperture which is part of the ventilation channel and through which air flows into the liquid store in an inflow direction. The ventilation aperture has a minimum clear cross section of at most $3 \cdot 10^{-2}$ mm$^2$.

19 Claims, 8 Drawing Sheets

(56) References Cited

U.S. PATENT DOCUMENTS

| | | | | |
|---|---|---|---|---|
| 5,605,257 | A * | 2/1997 | Beard | B05B 11/0072 222/189.09 |
| 5,664,703 | A * | 9/1997 | Reifenberger | B05B 11/0064 222/207 |
| 5,992,704 | A * | 11/1999 | Jager-Waldau | B05B 11/0005 222/341 |
| 7,726,522 | B2 * | 6/2010 | Greiner-Perth | B05B 11/3039 222/321.6 |
| 9,700,907 | B2 | 7/2017 | Greiner-Perth et al. | |
| 9,815,609 | B2 | 11/2017 | Wochele | |
| 2004/0055457 | A1 * | 3/2004 | Masuda | B05B 11/3035 92/13 |
| 2005/0127105 | A1 | 6/2005 | Kay | |
| 2005/0127107 | A1 * | 6/2005 | Mbonyumuhire | B05B 11/0044 222/383.1 |
| 2007/0284393 | A1 * | 12/2007 | Ritsche | B05B 11/00444 222/189.09 |
| 2010/0116849 | A1 * | 5/2010 | Lautre | B05B 11/3033 222/153.13 |
| 2010/0282776 | A1 | 11/2010 | Knopow et al. | |
| 2012/0145747 | A1 * | 6/2012 | Knopow | B67D 7/005 222/375 |
| 2013/0008923 | A1 * | 1/2013 | Syson | B05B 11/3042 222/189.09 |
| 2018/0338650 | A1 * | 11/2018 | Duarte | A47K 10/36 |

FOREIGN PATENT DOCUMENTS

| | | | |
|---|---|---|---|
| CN | 102458677 | A | 5/2012 |
| DE | 69213248 | T2 | 4/1997 |
| DE | 19605153 | A1 | 8/1997 |
| DE | 19851404 | A1 | 5/2000 |
| DE | 102004044344 | A1 | 3/2006 |
| DE | 102009051570 | B3 | 6/2011 |
| EP | 1295644 | B1 | 3/2003 |
| EP | 2314380 | A2 | 4/2011 |
| EP | 2644279 | A1 | 10/2013 |
| EP | 3010827 | A1 | 4/2016 |
| EP | 3010827 | B1 | 4/2016 |
| WO | 2014202278 | A1 | 12/2014 |

OTHER PUBLICATIONS

Written Opinion of International Searching Authority issued in Application No. PCT/EP2018/066685 dated Aug. 24, 2018 (7 pages).

Office Action issued in corresponding Indian Application No. 201917053560 dated Mar. 20, 2021 (7 pages).

Chinese Office Action issued in corresponding Chinese Application No. 201880046760.2 dated May 26, 2021 (7 pages).

Chinese Office Action with English Translation issued in corresponding Chinese Application No. 201880046760.2 dated Dec. 10, 2020 (11 pages).

* cited by examiner

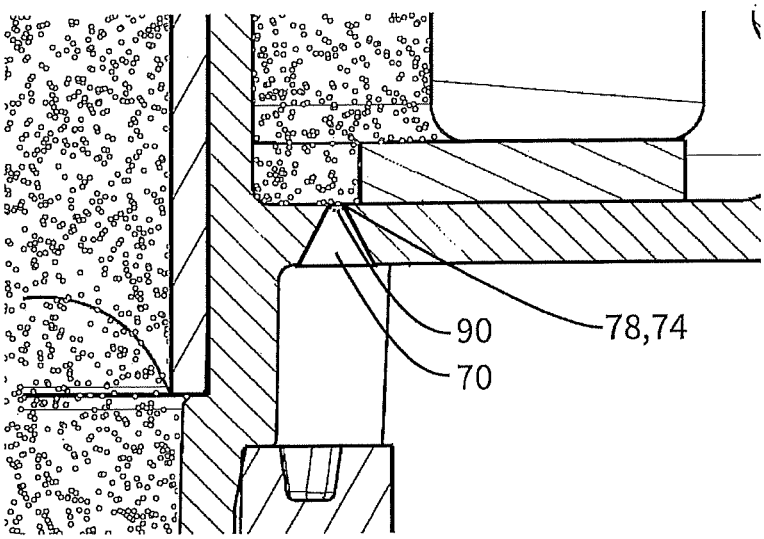
Fig. 4
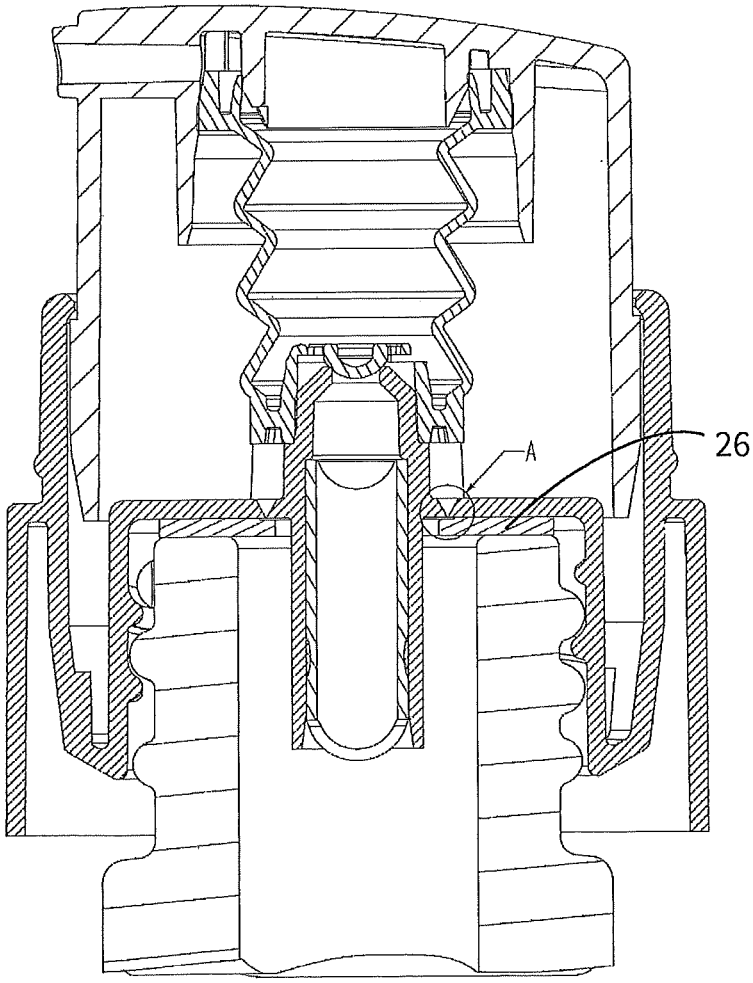
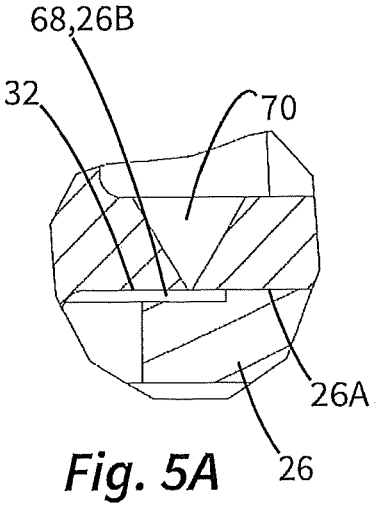
Fig. 5A
Fig. 5

LIQUID DISPENSER WITH VENTILATED BOTTLE AND DISCHARGE HEAD FOR THIS PURPOSE

FIELD OF USE AND PRIOR ART

The invention relates to a discharge head for a liquid dispenser for dispensing cosmetic or pharmaceutical liquids including a coupling device for fastening to an outlet connector of a liquid store, a liquid inlet, a discharge opening, a pump device for conveying liquid from the liquid inlet to the discharge opening and a ventilation channel which connects external surroundings of the discharge head to an interior of the liquid store. The invention also relates to a liquid dispenser including a liquid store having an outlet connector and a discharge head fastened by a coupling device to the outlet connector.

In the case of a dispenser of said type, provision is made whereby liquid is conveyed from the liquid store to the discharge opening by means of the pump device. In order that the volume loss resulting from the extracted liquid does not lead to a negative pressure in the liquid store, which leads to disruptions in the discharging action, the ventilation channel is provided through which air is drawn into the liquid store from surroundings by the negative pressure, in order to realize the pressure equalization.

Ventilation devices on generic dispensers with a ventilation channel that connects the surroundings to the liquid store are known. For example, from EP 1295644 A1, it is known for a small pressure equalizing opening to be provided which is closed by a filter membrane. This solution is relatively complex owing to the additional filter component with membrane, and is too expensive for simple fields of use. Furthermore, liquid can wet the membrane and impede the pressure equalization.

PROBLEM AND SOLUTION

It is an object of the invention to provide a generic discharge head which, with few components, can be produced inexpensively.

According to the invention, for this purpose, a discharge head is proposed which has a coupling device, preferably in the form of an internal thread or of a detent coupling device, for the fastening to an outlet connector of a liquid store and which provides a liquid inlet directed in the direction of the liquid store and also a discharge opening. The discharge head has a pump device for conveying liquid from the liquid inlet to the discharge opening, and has a ventilation channel which connects external surroundings of the discharge head to an interior of the liquid store.

The discharge head furthermore has an end surface which, together with the coupling device, is part of a unipartite main component. Said end surface thus covers and closes the outlet on the side of the discharge head and is extended through by the liquid inlet, wherein a riser pipe is commonly fastened as a separate component to the end surface by means of a plug-in connection and projects into the liquid store.

Furthermore, in the end surface, there is provided at least one ventilation aperture, preferably multiple such ventilation apertures. Said ventilation aperture is part of the ventilation channel and, as it were, constitutes the liquid-store-side end of the channel.

The at least one ventilation aperture is distinguished by a minimum clear cross section at its narrowest point of at most $3 \cdot 10^{-2}$ mm$^2$, preferably of at most $1 \cdot 10^{-2}$ mm$^2$, particularly preferably of at most $5 \cdot 10^{-3}$ mm$^2$.

In the case of a discharge head according to the invention, the ventilation thus takes place through very small apertures which extend directly through said end surface and, in so doing, are in particular oriented preferably parallel to the main extent direction of the outlet connector, which is commonly approximately cylindrical, of the liquid store. It is preferable for multiple such apertures to be provided in order to ensure a sufficiently fast pressure equalization despite the small clear cross section. Other embodiments with only one ventilation aperture are however also possible. Where reference is made below to a multiplicity of ventilation apertures, the statements equally also relate to a design with only one ventilation aperture, unless the statements explicitly state otherwise.

The ventilation apertures are freely accessible from the liquid store and from the surroundings through the ventilation channel, that is to say are not separated by a membrane or some other permanent or switchable closure means. If a liquid dispenser with a discharge head of said type is turned into an upside-down position, the liquid is correspondingly present directly at the end surface through which the ventilation apertures extend, such that no additional protection whatsoever is provided between the liquid and the ventilation apertures.

However, the particularly small design of the ventilation apertures has the effect that the liquid normally does not ingress into the ventilation apertures or, if it does ingress, does not pass all the way through said ventilation apertures. Instead, under the action of the surface tension, a domed liquid surface forms at the liquid-store-side entrance of the ventilation aperture, in the ventilation aperture, or at the entrance on the side averted from the liquid store.

The maximum diameter of $5 \cdot 10^{-3}$ mm$^2$ is commonly sufficient in the case of aqueous cosmetic or pharmaceutical liquids in the liquid store and in the case of a fill level of the liquid store of up to approximately 10 cm. Other liquids, for example cosmetic liquids of higher viscosity, cannot pass through, or cannot pass through in relevant quantities, even in the case of larger diameters.

Whether a liquid surface, which prevents an escape of the liquid in relevant quantities, forms in the desired manner at the ventilation apertures is also dependent on the shaping of the cross section of the ventilation apertures. Basically, a circular or rounded shaping of the cross section is preferred. However, polygonal cross sections may also be advantageous from a production aspect and sufficiently reliable in terms of operation.

The ventilation apertures form the final part of the ventilation channel. The feed of the air as far as the side situated opposite the liquid store is realized preferably through a non-sealed gap between the actuating handle and the base, though may for example also be realized through a dedicated opening in the base or in another part of the discharge head.

The embodiment according to the invention of the ventilation apertures is very simple from a production aspect and is therefore suitable in particular for inexpensive discharge heads, which in turn are used in the case of relatively low-cost products such as soap dispensers. A discharge head of said type is preferably a discharge head with the stated main component, which is provided as a base on the liquid store, and an actuating pushbutton mounted in slidingly movable fashion on said main component. These two components preferably together define an interior space in which a pump chamber of the pump device is arranged. It may likewise be expedient for the pump device to be designed so as to be formed by an elastically compressible and in particular bellows-like hollow body which is of open form at an entrance side and at an exit side. Such a hollow body performs a dual function, because, owing to its elasticity, it can eliminate the need for a separate resetting spring. Provision may furthermore be made whereby an inlet valve at the entrance side of the pump chamber and/or an outlet valve at the exit side of the pump chamber are formed in one piece with said hollow body.

Thus, a discharge head according to the invention can, with a special design and disregarding a possibly provided riser pipe and a possibly provided cap, be constructed from only three components, specifically the pump chamber component with integrally formed valves, the main component with coupling device, liquid inlet and the ventilation apertures according to the invention, and the actuating pushbutton.

The shaping of the ventilation apertures in the extent direction may be purely cylindrical, preferably circular cylindrical. This is however associated with increased and normally unjustified additional outlay in relation to other alternatives.

Accordingly, the ventilation apertures may also be formed as an opening which narrows steadily in an inflow direction or counter to the inflow direction, wherein this is to be understood to mean that the cross section narrows in one direction in continuous fashion and/or in the region of steps, wherein cylindrical sub-portions may also be provided. The simplest form of such a design is provided in the case of a truncated-cone-shaped or truncated-pyramid-shaped shaping of the aperture. The advantage of such a design lies in the simplicity of the injection mold required for the production process, because only one mold portion of the injection mold on one side of the end surface to be produced has to have a correspondingly fine structure for the generation of the ventilation apertures, whereas the opposite mold portion of the injection mold can be of simple design. Designs are however basically also conceivable in which corresponding structures are provided on both mold portions, which structures together keep the ventilation apertures free and thus generate a ventilation aperture which narrows from both sides of the end surface toward the opposite side.

It is advantageous if a cylindrical channel portion whose length corresponds at least to the mean diameter at said cylindrical channel portion forms the location of the minimum clear cross section. The respective end of truncated-cone-shaped or truncated-pyramid-shaped channel portions, which may be oriented in the inflow direction or counter to the inflow direction, may also form the location of the minimum clear cross section.

The number of ventilation apertures provided is dependent on the usage situation. Since the ventilation apertures impart an intense throttling action, a single ventilation aperture commonly suffices only if there is no requirement for discharging relatively large quantities of liquid in a short period of time. In the case of cosmetic liquids such as soap, which are discharged in relatively large quantities, a multiplicity of ventilation apertures must be provided, for example 2, 3, 4, 5, 6 or 8 ventilation apertures. These apertures may be arranged close together. A certain spacing is however advantageous, such that at least two ventilation apertures are spaced apart from one another transversely with respect to the orientation of the outlet connector by at least 5 mm. In the case of a preferred arrangement in which the ventilation apertures are arranged so as to surround or partially surround the liquid inlet, two ventilation apertures are preferably spaced apart from one another at least by an angle of 60° in relation to the liquid inlet.

The spacing of the ventilation apertures is intended in particular to have the effect that, in the event of the undesired passage of liquid through one ventilation aperture, closely adjacent ventilation apertures do not likewise fill with liquid proceeding from the side averted from the liquid store and thus permit the undesired passage of liquid through the ventilation openings to a yet further increased degree.

As has already been discussed, the concept of the ventilation apertures is based on the fact that, in a situation arising for example during transport in which the liquid dispenser is in an upside-down position, the liquid is present at the ventilation apertures and, here, cannot pass through, or can pass through only to a small extent, in each case owing to the surface tension. There is no imperative need for the end surface to be formed from a particular material or with particular coatings for this purpose.

However, reliability can be yet further increased if the main component is manufactured from a plastic which, with the addition of an additive, is formed as an altogether hydrophilic or hydrophobic component, and/or if the main component is, at the end surface, provided with a hydrophilic or hydrophobic coating on one or both sides.

In the context of the surfaces proposed here, hydrophilic and hydrophobic designs are to be understood in relation to water as a reference liquid. A body or the surface thereof is hydrophilic if a contact angle $\theta$ of a water droplet resting on a corresponding planar surface amounts to less than 75°. Hydrophobicity is realized if the contact angle $\theta$ amounts to more than 115°.

On that side of the end surface which points in the direction of the liquid store, both a hydrophilic and a hydrophobic form may be advantageous. A hydrophobic form has the effect that liquid present on the end side quickly drips off from said end side after a return from the upside-down position into the initial position.

The hydrophilic form of the end surface pointing toward the liquid store is expedient if, by contrast to this, the inner surfaces of the ventilation apertures and/or the opposite side of the end surface is of non-hydrophilic or even hydrophobic form. This can be realized for example by means of a hydrophilic coating on the side facing toward the liquid store. In the case of such a design, liquid that has passed into the ventilation apertures is drawn back into the liquid store again.

Since liquid has the tendency, at the transition between hydrophilic and hydrophobic surfaces or at the transition between hydrophilic or hydrophobic surfaces and surfaces which are not of such form, to form a stable surface which, under the action of the surface tension, prevents the outflow of liquid under the action of gravitational force, such a step change in hydrophilicity is provided preferably at the entrance of the ventilation apertures, at the exit thereof, or in the course thereof.

In order to form a particular location in the ventilation apertures such that the formation of the surface of the liquid takes place preferentially at that location, provision may be made whereby the wall surrounding the ventilation aperture has, in the course of the ventilation aperture, at least one surface-forming edge at which portions of the wall converge on one another at an angle of at least 135° and which is of sharp-edged form with a radius of curvature of <0.1 mm. It has been found that a sharp-edged formation extending in the ventilation apertures in the extent direction thereof tends to disrupt the formation of a surface. However, an encircling sharp edge promotes the surface formation in the region of said edge.

It may also be advantageous for multiple such surface-forming edges to be arranged one behind the other at one ventilation aperture, such that multiple locations that promote the surface formation are hereby formed. In this way, it is for example possible to compensate production-induced damage to one of the surface-forming edges.

The ventilation apertures are preferably designed such that, in an upside-down position and in the case of a full liquid store, they prevent a passage of the liquid under the action of the hydrostatic pressure caused by the liquid level. In order to prevent a considerably higher pressure from arising as a result of movement of the dispenser such as rattling and shaking, the liquid-dispenser-side end of the ventilation aperture is preferably arranged such that a surface portion, spaced apart from the end, of a further component or of the main component itself, by forming a narrow slot, protects the end of the ventilation aperture against liquid impinging thereon.

Particularly advantageous for this purpose is an embodiment in which the discharge head has a sealing ring for the purposes of circumferentially sealing the discharge head with respect to the outlet connector of the liquid store. Said sealing ring preferably has an areal extent and in particular an inner diameter such that, in relation to the main extent direction of the outlet connector of the liquid store, said sealing ring covers the at least one ventilation aperture, and here, said sealing ring is spaced apart from an exit side of the ventilation aperture so as to form the stated narrow slot, such that air can pass into the liquid store past the sealing ring. Here, the sealing ring preferably completely covers that end of the ventilation aperture which faces toward said sealing ring, or the local clear cross section, such that liquid that is moved in the main extent direction as a result of shaking or the like cannot pass directly into the ventilation aperture.

The sealing ring particularly preferably has an inner radius which is smaller than the spacing of at least one of the ventilation openings from a central axis defined by the liquid inlet. The sealing ring performs, as it were, a dual function, specifically the conventional sealing action and that of an impingement guard.

Here, multiple embodiments are conceivable in which in each case that side of the end surface which faces toward the liquid store has a planar abutment surface against which the sealing ring bears. Thus, that side of the end surface which faces toward the liquid store may have a region which is recessed in relation to the abutment surface and into which the at least one ventilation aperture opens. Such a depression in which one or more ventilation apertures open may be opened radially inward in the manner of a pocket or radially inward in encircling fashion. Since the sealing ring bears against the abutment surface which is offset in relation to said depression, the inflowing air can flow radially inward in the slot formed by the depression and then onward into the liquid store. Said depressions on the end surface are technically easy to produce by injection molding and permit the use of unmodified sealing rings which are planar on both sides. Alternatively or in addition, provision may be made whereby the sealing ring has; on that side of said sealing ring which faces toward the end surface, a region which is recessed in relation to the abutment surface, wherein the recessed region is arranged such that the at least one ventilation aperture opens into said recessed region of the sealing ring. Even if the depressions are provided not on the end surface but rather on the sealing ring, the two above-stated shaping configurations are possible, on the one hand the encircling depression which extends in particular as far as the inner diameter of the sealing ring and which forms a common slot for ventilation for all ventilation apertures, and on the other hand, pocket-like local depressions into which possibly only one or only a small number of ventilation apertures out of all ventilation apertures open.

The invention furthermore relates to a liquid dispenser which firstly has a liquid store with an outlet connector and which secondly comprises a discharge head which is coupled by means of a detent or threaded connection to the outlet connector. Here, said discharge head is designed according to the invention in the manner described above.

The liquid dispenser is preferably filled with a cosmetic liquid such as a soap or lotion, which can be discharged by means of the actuating handle of the discharge head.

The ventilation apertures are adapted to the shaping, the fill quantity and the intended content of the liquid store such that, in the manner outlined above, in the upside-down position, at all ventilation apertures, surfaces form which prevent draining of the liquid store through the ventilation apertures under the action of gravitational force. In the case of an embodiment according to the invention, it is not always of importance to completely prevent the undesired escape of liquid through the ventilation apertures. It is normally sufficient for such an escape to be minimized.

BRIEF DESCRIPTION OF THE DRAWINGS

Further advantages and aspects of the invention will emerge from the claims and from the following description of preferred exemplary embodiments of the invention, which are discussed below on the basis of the figures.

FIG. 4 illustrates the action of the ventilation apertures in the case of an orientation of the dispenser in an upside-down position.

FIGS. 5 and 5A show a second exemplary embodiment in a sectional illustration of the discharge head with an enlarged detail.

DETAILED DESCRIPTION OF THE EXEMPLARY EMBODIMENTS

Figure 1:
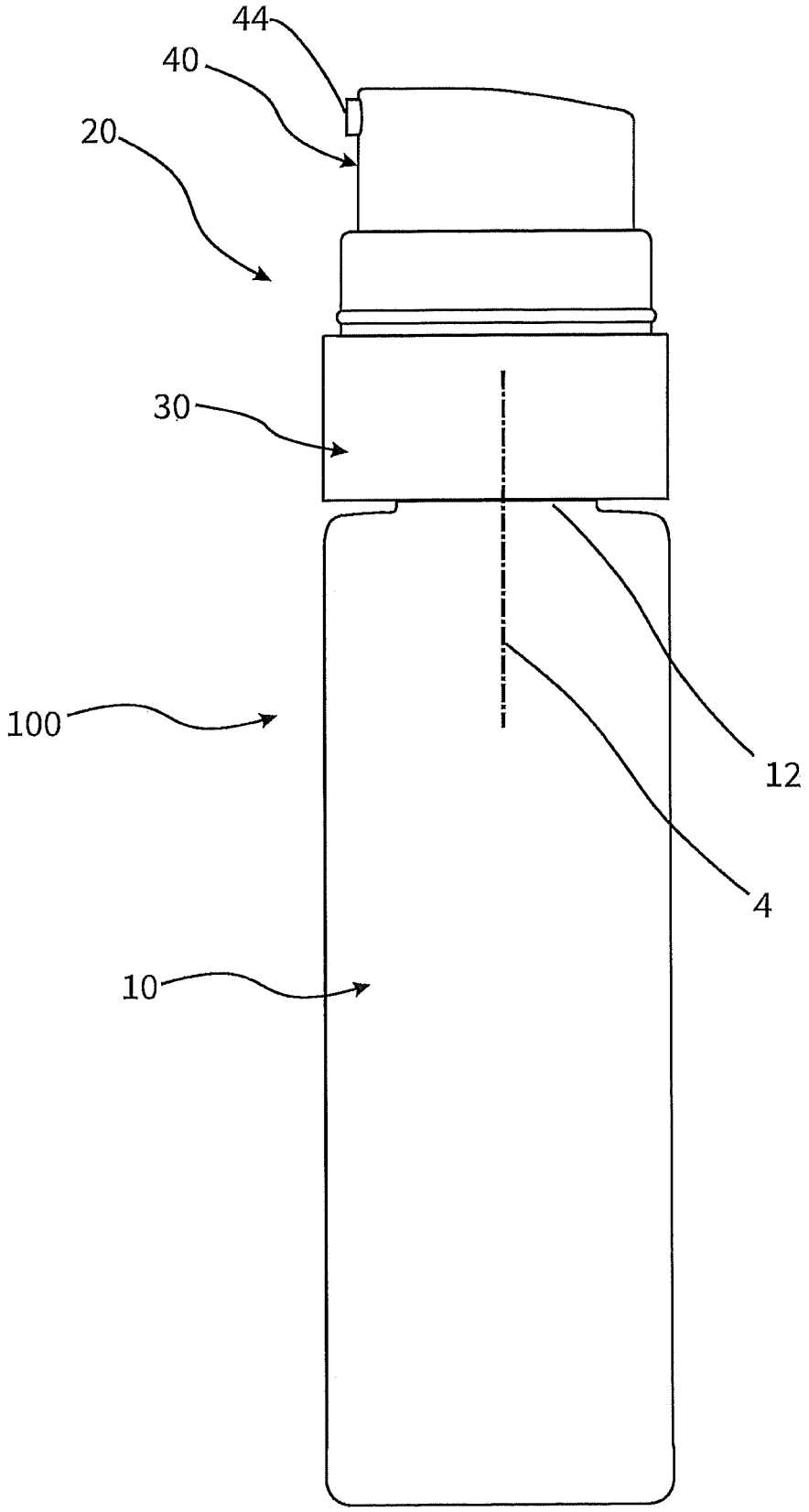
FIG. 1 shows a dispenser according to the invention in an overall illustration.

FIG. 1 shows a liquid dispenser 100 according to the invention, in the present case a liquid dispenser for discharging cosmetic lotions. The liquid dispenser 100 has a liquid store 10 in the form of a bottle, at the upper end of which there is arranged an outlet connector 12 with an external thread that is not illustrated in FIG. 1. The liquid store 10 is screwed into a discharge head 20, which itself has a main component 30 which forms the base of the discharge head 20 and on which an actuating pushbutton 40 is mounted so as to be slidingly displaceable in an actuating direction 4. The outlet connector 12 of the dispenser 100 extends along this same direction 4.

The discharge head 20 has a pump device 50 which is not illustrated in FIG. 1 and by means of which liquid can be conveyed out of the liquid store 10 to a discharge opening 44.

Since the quantity of liquid remaining in the liquid store 10 is hereby reduced, air from a surrounding atmosphere must pass into the liquid store 10 for the purposes of pressure equalization. The problem here lies in the fact that a ventilation channel that leads into the liquid store 10 from external surroundings simultaneously also allows liquid to escape through the ventilation channel in an upside-down position of the liquid dispenser 100, for example if the dispenser is transported in a bag.

The ventilation device described below serves for the purpose of permitting the ventilation without the risk of a relevant quantity of liquid escaping in the upside-down position.

Figure 2:
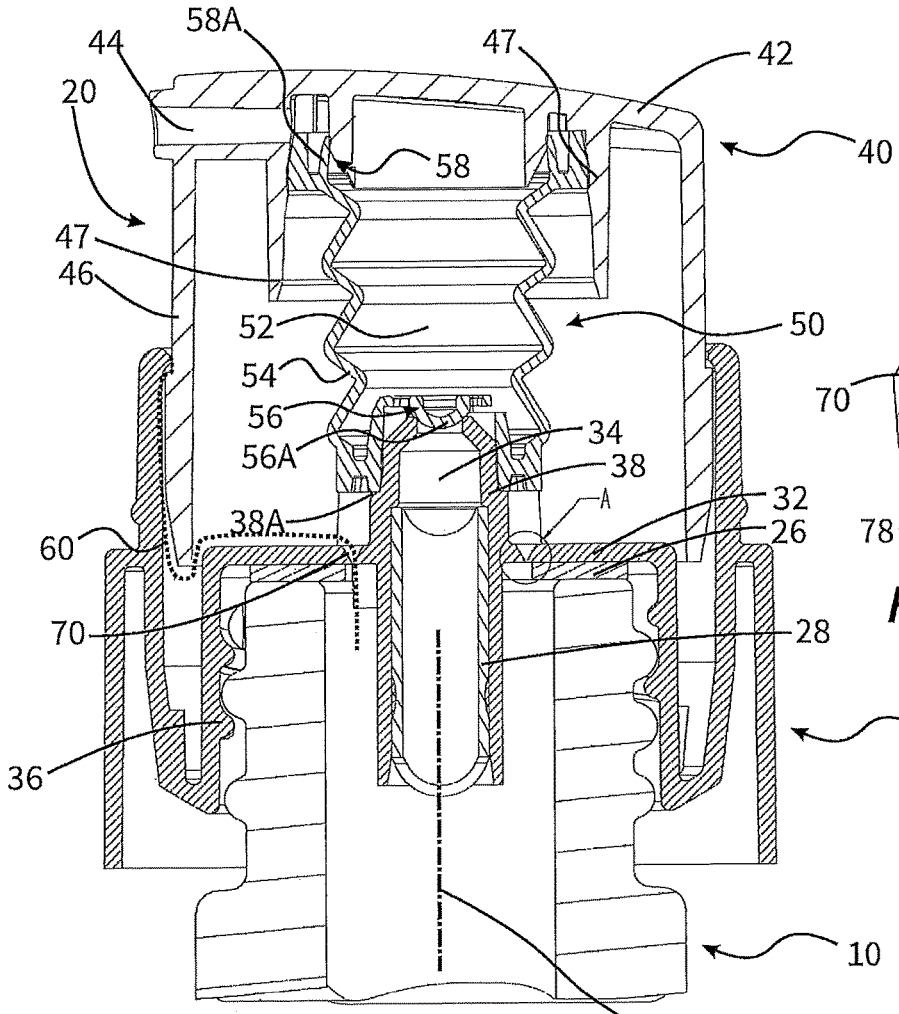
FIGS. 2 and 2A show a first exemplary embodiment in a sectional illustration of the discharge head with an enlarged detail.
Figure 2A:
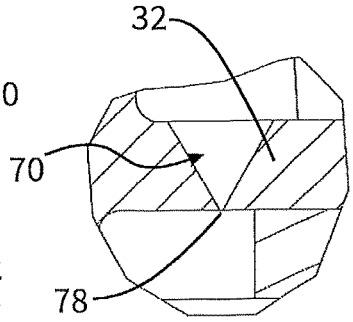

FIG. 2 shows a first exemplary embodiment of a dispenser according to the invention, and of the discharge head thereof, in a sectional view. It can be seen that the pump device 50 is formed by virtue of a bellows-like hollow body 54, which is of open form at its entrance side and its exit side, being fastened to the main component 30 and to the actuating pushbutton 40, wherein said hollow body is, at the main component 30, clamped onto a pump chamber connector 38 which, by means of a stop surface 38A, limits the pushing-on length of the hollow body 54.

At the actuating pushbutton 40, the hollow body 54 is clamped into a sleeve portion 47. That wall of the hollow body 54 which surrounds the pump chamber 52 is of bellows-like form in order to realize a reproducible compression when the actuating pushbutton 40 is pushed down by manual exertion of force on the pressure surface 42. At the entrance side and at the exit side of the pump chamber 52, there are provided an inlet valve 56 and an outlet valve 58, wherein both valves each have an elastic valve portion 56A, 58A which is in each case formed integrally on the hollow body 54, such that, in addition to the main component 30 and the actuating pushbutton 40, only one further component is required in order to provide a reliable pump device.

The main component 30 is that component which provides the coupling device 36, in the present case in the form of an internal thread. Said main component is at the same time that component which forms an end surface 32 on an end wall of the mail component 30, which end surface 32 in the present case is of substantially planar form, though need not be of such form, and which closes off the liquid store 10 in the region of its outlet connector 12. For the purposes of sealing, a sealing ring 26 is provided, which is of functional importance in the context of the invention in the second embodiment described in more detail below. The end surface 32 of the main component 30 is extended through by an opening for two purposes. Firstly, the liquid inlet 34 is provided here, which opens into the pump chamber connector 38 and on which a riser pipe 28 is provided which projects into the liquid store 10.

Furthermore, the end surface 32 is interrupted by a total of eight ventilation apertures 70 which are part of a ventilation channel 60 by means of which, after the discharge of liquid, air can flow into the liquid store 10 for the purposes of the pressure equalization. The ventilation channel 60 or ventilation path is illustrated in its entirety by a dashed line. The ventilation path runs through a gap between the main component 30 and the actuating pushbutton 40 into an interior space formed by said two components, and from there to the ventilation apertures 70.

Here, as will be discussed in more detail below, the ventilation apertures 70 are of such slim form that, although air can flow in, no liquid flows out under normal conditions.

Figure 3:
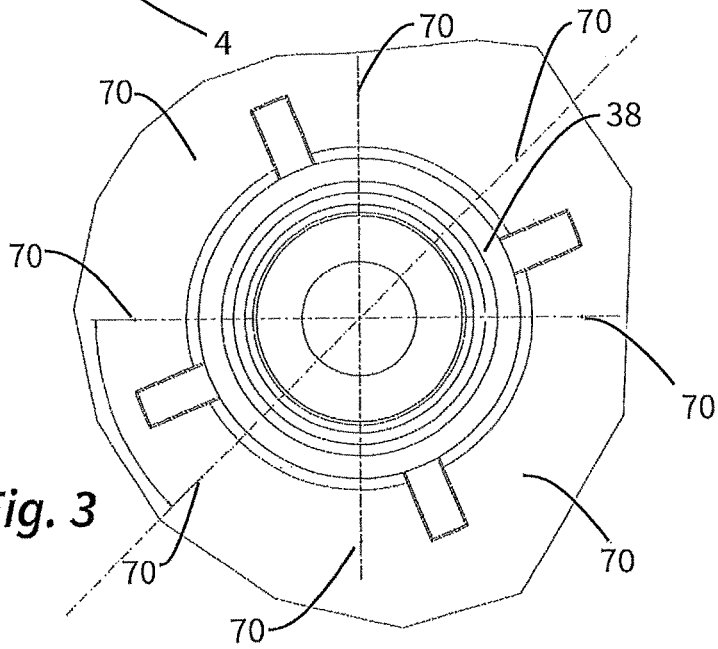
FIG. 3 shows, in a view from the liquid store, the arrangement of ventilation apertures in the end wall of the discharge head.

As illustrated on the basis of FIG. 3, a total of eight ventilation apertures 70 is provided, because, owing to the very slim form of the ventilation apertures 70, one on its own would not be sufficient to compensate the loss of liquid in the liquid store 10 as a result of multiple successive actuations. Here, the eight ventilation apertures 70 are arranged uniformly with spacings of 45° with respect to one another so as to surround the pump chamber connector 38 and the central axis thereof, resulting in a large spacing between the ventilation apertures 70. The spacing between mutually opposite ventilation apertures 70 amounts to approximately 25 mm, and the spacing between adjacent ventilation apertures 70 amounts to approximately 8 mm. This serves the purpose that, in the event of an undesired passage of liquid through one of the ventilation apertures 70, the liquid should as far as possible not run, on that side of the end surface 32 which is averted from the liquid store 10, into the region of another ventilation aperture, so as not to disrupt the function thereof.

FIG. 4 shows a detail of the discharge head 20 of FIG. 1 in an upside-down position of the dispenser 100. It can be seen that the liquid, indicated by means of bubbles, flows as far as the ventilation aperture 70 and, at the channel portion 74 thereof with minimum clear cross section and with a sharp-angled surface-forming edge 78 of approximately 60°, a domed surface 90 illustrated by dashed lines forms which, owing to the surface tension of the liquid, prevents the ingress of further liquid into the ventilation aperture 70. Even if liquid passes into the ventilation aperture 70, it is in turn the case, at the opposite side of the ventilation aperture 70, that a situation arises in which a domed surface forms which is stable under the action of the surface tension of the liquid and which prevents the passage of further liquid in an effective manner.

FIGS. 5 and 5A show a somewhat different design. Here, the sealing ring 26 is provided with a smaller inner diameter, and additionally with a depression 26B on its top side, such that, here, the top side of the sealing ring 26 is recessed somewhat in relation to an abutment surface 26A of the sealing ring 26 which is disposed against the end surface 32. Together with the end surface 32, a very narrow slot 68 is hereby formed, which however does not impede the entry of air into the liquid store 10.

By means of this design, it is ensured that the ventilation apertures 70 are not, as a result of jerky movements of the liquid dispenser 100 or even a shaking action, acted on by liquid impinging directly on the ventilation aperture 70, which would be capable of passing through the ventilation aperture 70.

FIGS. 6A to 6H show different possible embodiments of the ventilation apertures 70.

Figure 6A:
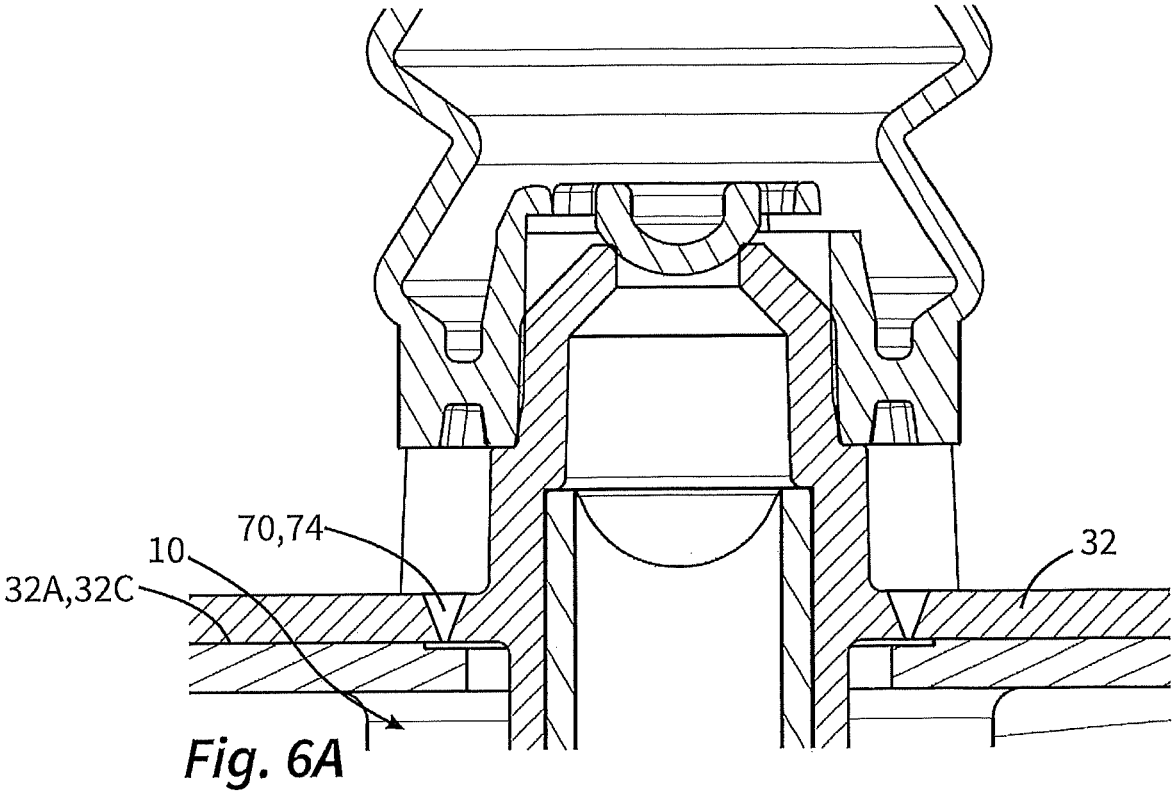
FIGS. 6A to 6H show different variants regarding the shaping of the ventilation apertures.
Figure 6B:
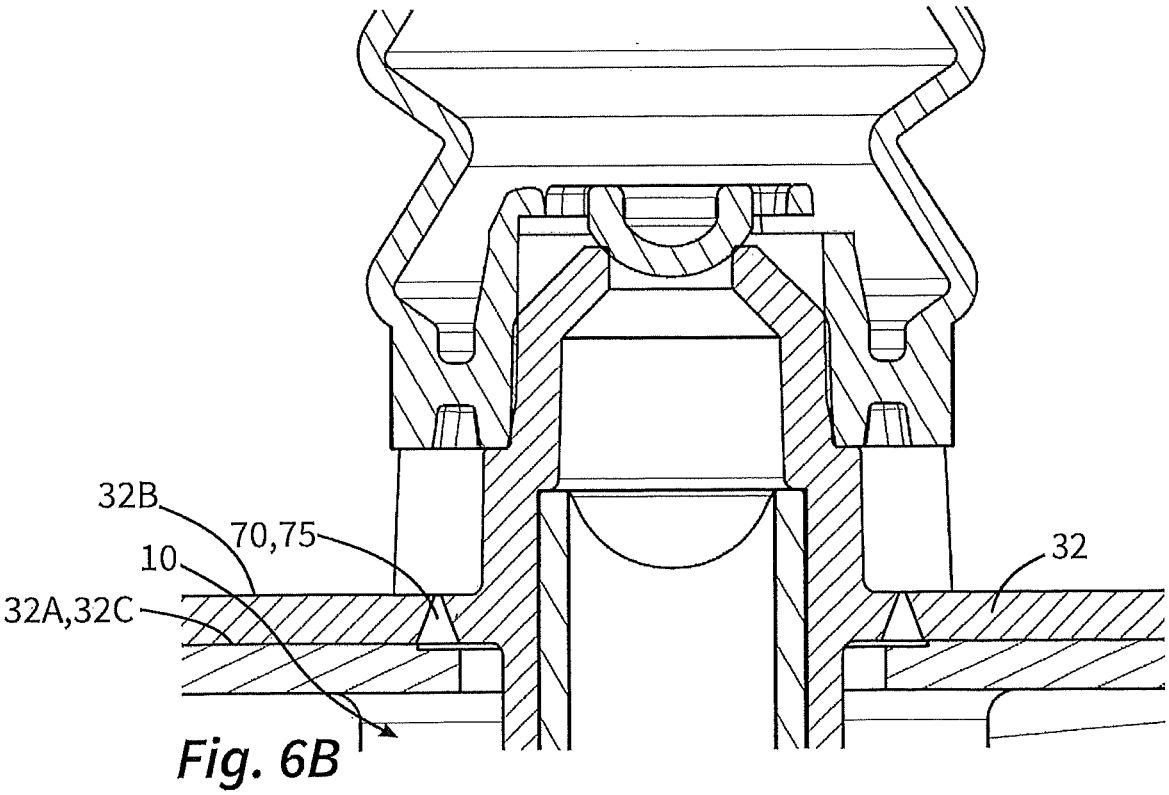

In the case of FIGS. 6A and 6B, the ventilation apertures 70 are in each case of truncated-cone-shaped or truncated-pyramid-shaped form, wherein, in the case of the embodiment of FIG. 6A, said ventilation apertures narrow toward the liquid store 10 and, in the case of the embodiment of FIG. 6B, said ventilation apertures narrow in the opposite direction. Such ventilation apertures 70 are particularly easy to produce because mold portions of an injection mold for forming such ventilation apertures 70 are required only on one of the two mold parts for producing the main component 30. On the opposite side, the tool can be of planar form in the same region. It has been found that the liquid pressure required to pass through a ventilation aperture shaped in this way is scarcely lower than in the case of a purely cylindrical aperture as in FIG. 6D.

Figure 6C:
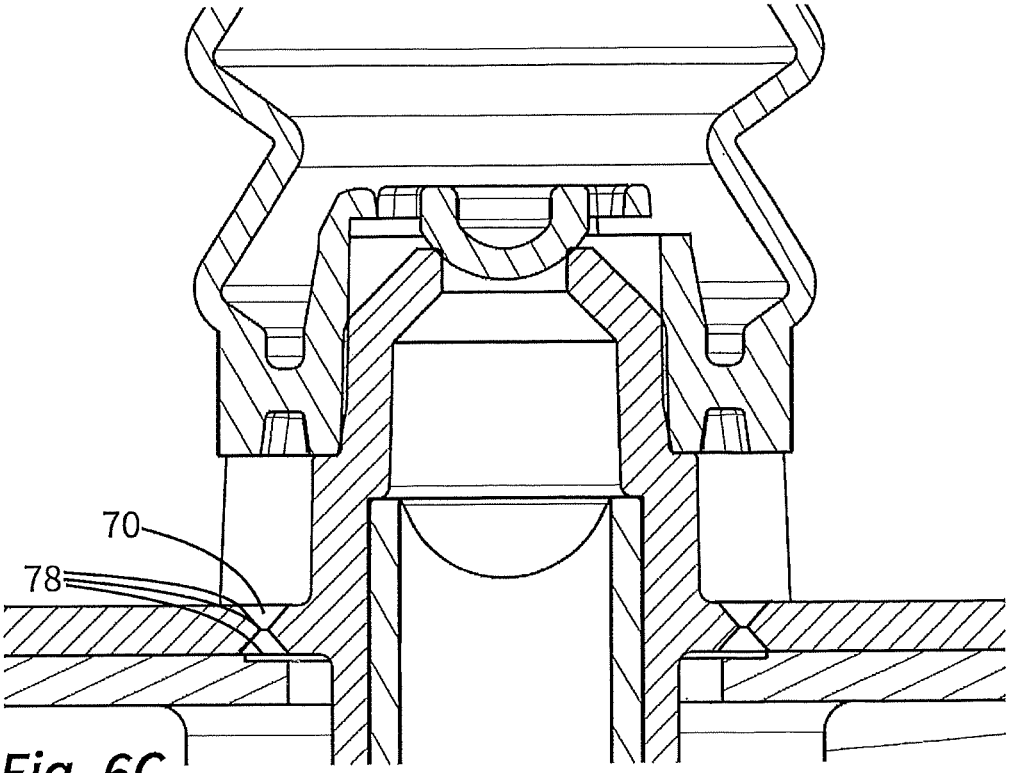
Figure 6D:
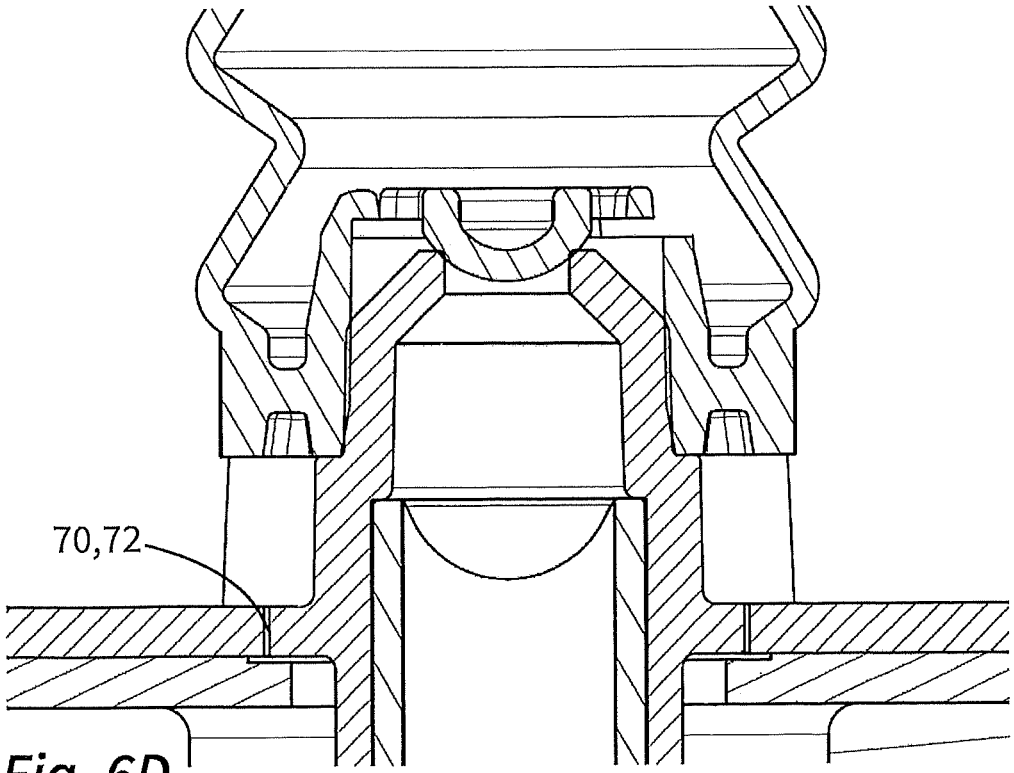

In the design as per FIG. 6C, the ventilation apertures 70 narrow proceeding from both sides. This yields three surface-forming edges 78 of approximately 135', approximately 90° and approximately 135° one behind the other, which are each suitable for preventing the escape of liquid.

Figure 6E:
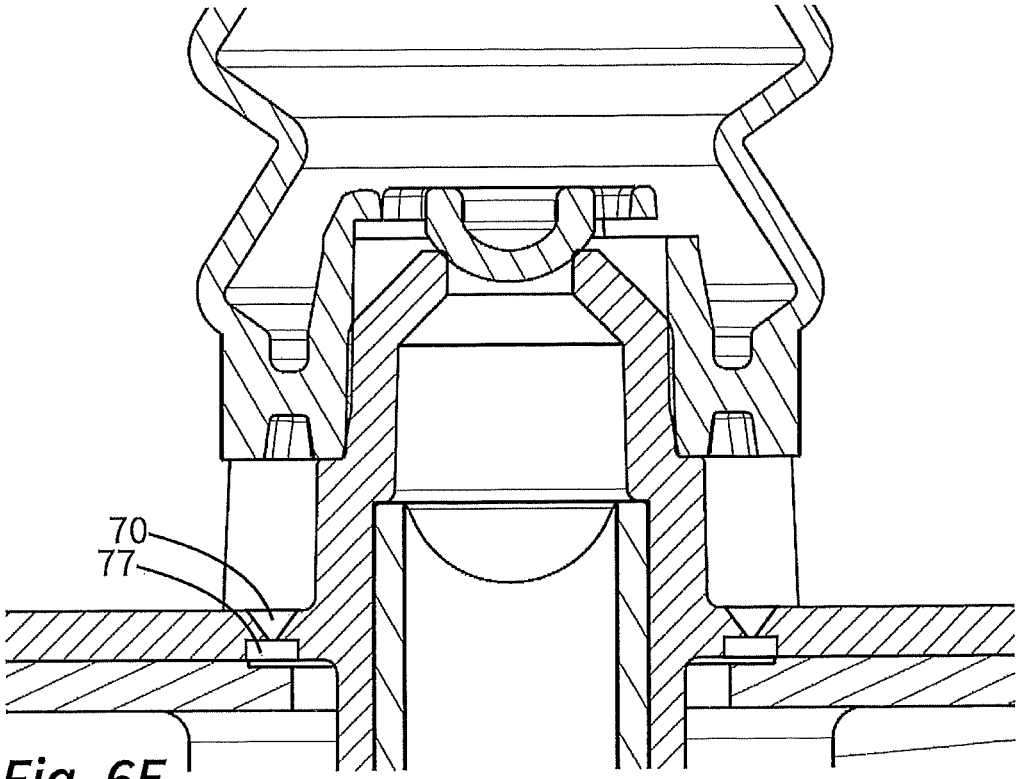
Figure 6F:
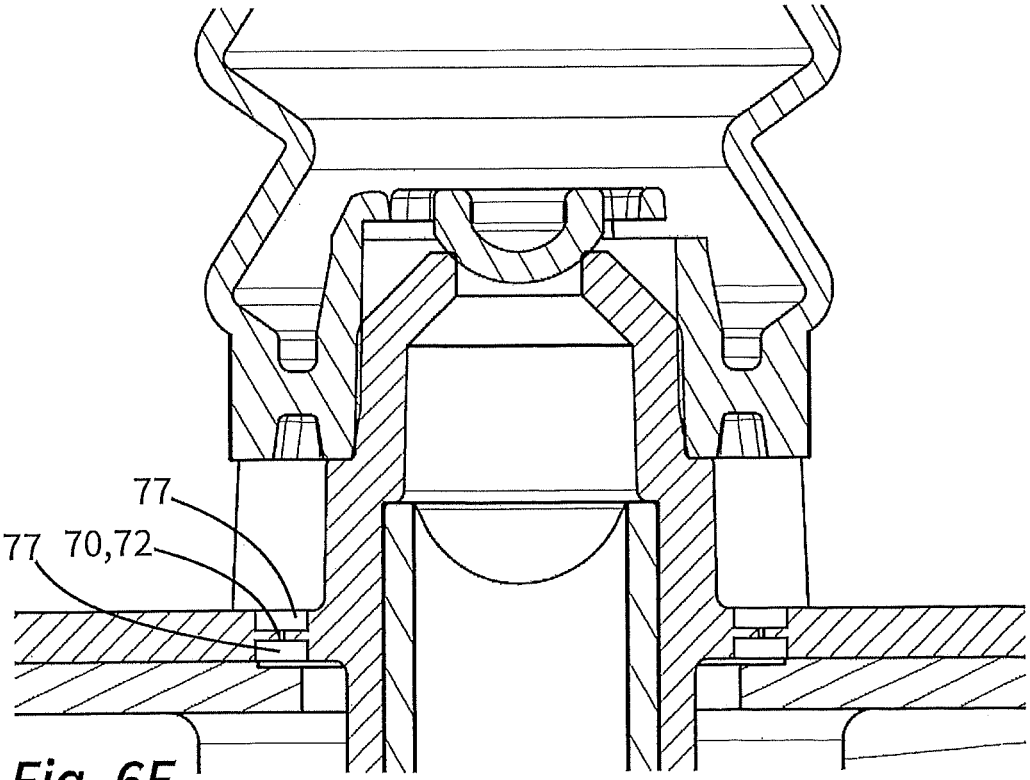

In the design of FIG. 6E, an encircling trench-like depression 77 is provided on the end surface 32, into which depression the ventilation apertures 70 open. The ventilation apertures 70 can thus be shorter, which makes the production process easier. In the case of the embodiment of FIG. 6F, such depressions 77 are provided to both sides of the end surface 32.

Figure 6G:
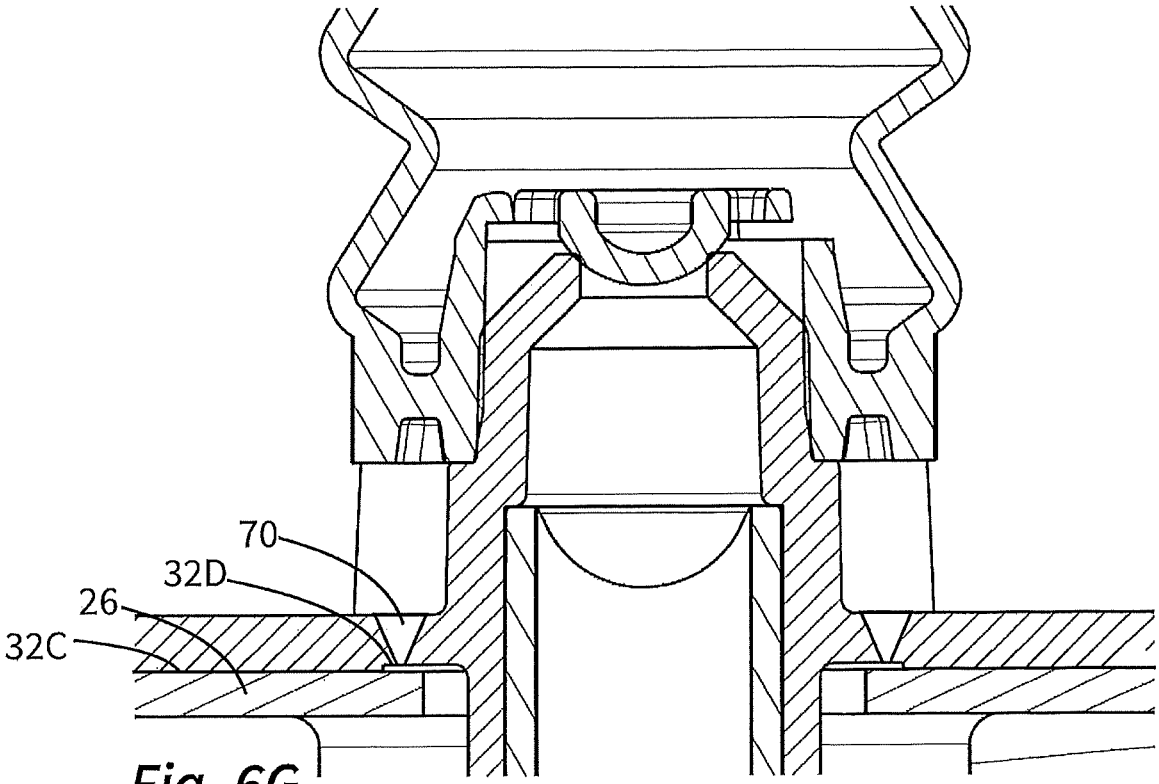

The design of FIG. 6G differs from the similar design of FIG. 6A in that the sealing ring 26 does not have a depression. Instead, a depression 32D is provided on the underside of the end surface 32, which depression likewise makes it possible to use a sealing ring 26 with an inner diameter which covers the ventilation apertures 70 and which therefore does not allow a direct impingement of the liquid on the ventilation aperture 70 in the event of the dispenser 100 being shaken.

Figure 6H:
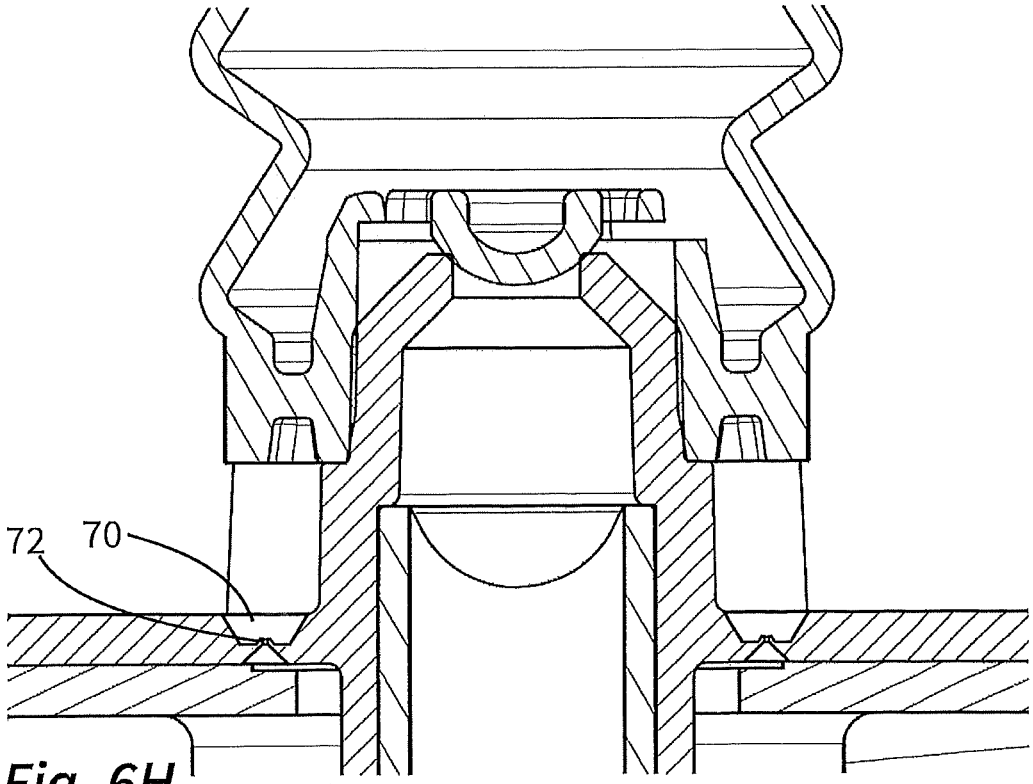

The design of FIG. 6H is one with relatively complex shaping of the ventilation aperture. The ventilation aperture 70 illustrated here has, at both sides, a conical shaping, wherein a short cylindrical sub-portion defines the point that is narrowed to the greatest degree.

Figure 7:
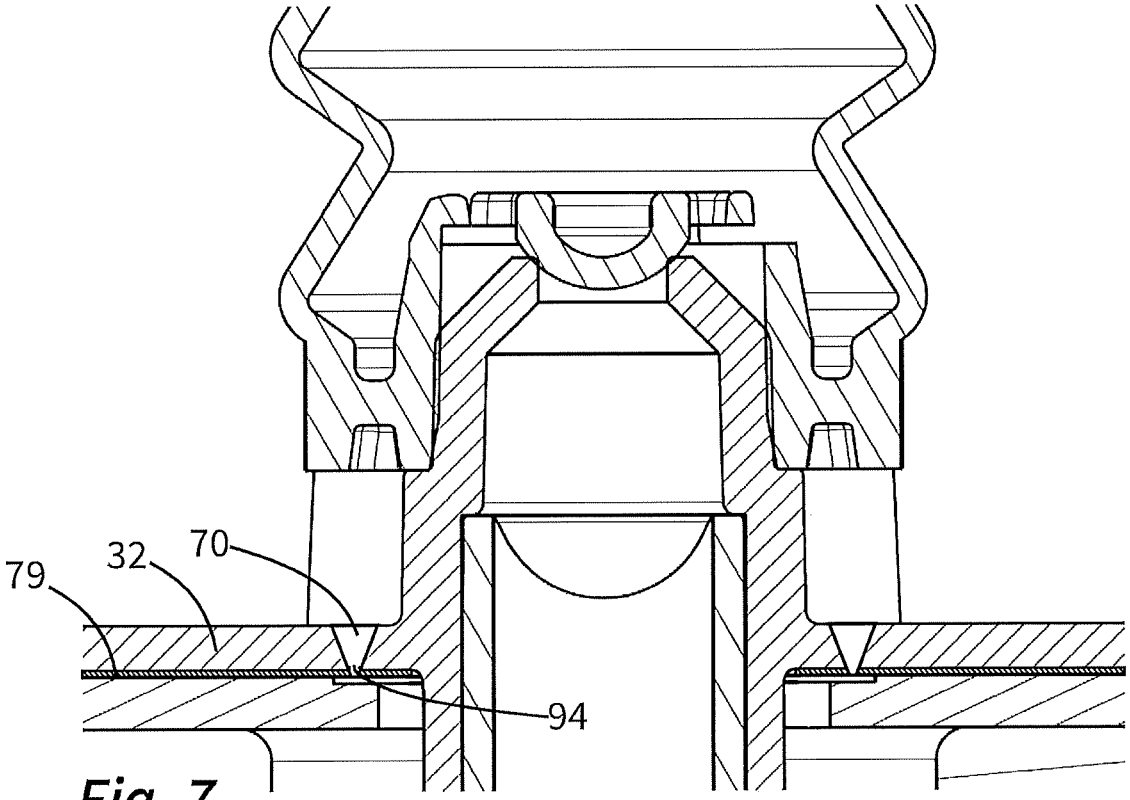
FIG. 7 illustrates the arrangement and effect of a partially hydrophobic embodiment of the discharge head.

In the design as per FIG. 7, the main component 30 and the end surface 32 are of hydrophobic design, but provided with a hydrophilic coating 79 on the bottom side thereof. This combination has the effect that, firstly, in the upside-down position, a liquid surface 94 which prevents the further passage of liquid forms in a particularly reliable manner at the boundary between the hydrophilic and the hydrophobic region. Additionally, liquid that has entered the ventilation apertures 70 during a brief period in the upside-down position is drawn from the hydrophobic ventilation aperture 70 back into the liquid store 10 by the hydrophilic coating 79 after a return into the initial position.

The invention claimed is:

1. A liquid dispenser for dispensing cosmetic or pharmaceutical liquids, comprising:

a liquid store filled with a cosmetic or pharmaceutical liquid and having an outlet connector; and a discharge head comprising:

a coupling device fastened to the outlet connector of the liquid store;

a liquid inlet directed in a direction of the liquid store and having a discharge opening;

a pump device for conveying liquid from the liquid inlet to the discharge opening;

a ventilation channel connecting external surroundings of the discharge head to an interior of the liquid store; and an end surface by which the liquid store is substantially closed off at a distal end of the outlet connector on a of the discharge head, the liquid inlet extending through the end surface, the end surface and the coupling device being formed in a unipartite fashion as part of a common main component, the end surface having at least one ventilation aperture which is part of the ventilation channel and through which air flows into the liquid store in an inflow direction, the at least one ventilation aperture having a cross-section, a narrowest part of the cross-section having a dimension not exceeding $3 \cdot 10^{-2}$ mm$^2$, the dimension of the narrowest part of the cross-section being adapted to a surface tension of the liquid in the liquid store such that a maximum hydrostatic pressure generated by the liquid in the liquid store does not result in liquid passing through the at least one ventilation aperture due to a surface tension of the liquid.

2. The liquid dispenser as claimed in claim 1, wherein the at least one ventilation aperture is formed as an opening which narrows steadily in the inflow direction.

3. The liquid dispenser as claimed in claim 1, wherein the at least one ventilation aperture is formed as an opening which narrows counter to the inflow direction.

4. The liquid dispenser as claimed in claim 1, wherein the at least one ventilation aperture is, at a location of the narrowest part of the cross-section, formed by a cylindrical channel portion having a length corresponding at least to a diameter of the cylindrical channel portion at said location.

5. The liquid dispenser as claimed in claim 1, wherein the at least one ventilation aperture has a truncated-cone-shaped or truncated-pyramid-shaped channel portion, a narrowest point of the channel portion corresponding with the narrowest part of the cross-section of the at least one ventilation aperture.

6. The liquid dispenser as claimed in claim 1, wherein the at least one ventilation aperture comprises a plurality.

7. The liquid dispenser as claimed in claim 1, wherein:

the main component comprises an altogether hydrophilic or hydrophobic component comprising a plastic with an additive; or the main component comprises, at the end surface, a hydrophilic or hydrophobic coating on one or both sides of the end surface.

8. The liquid dispenser as claimed in claim 1, wherein the discharge head has a sealing ring configured to circumferentially seal the discharge head with respect to the outlet connector of the liquid store, the sealing ring has an areal extent such that, in relation to a main extent direction of the outlet connector of the liquid store, said sealing ring covers the at least one ventilation aperture, and the sealing ring is spaced apart from an exit side of the at least one ventilation aperture so as to form a narrow slot such that air passes into the liquid store past the sealing ring.

9. The liquid dispenser as claimed in claim 8, wherein a side of the end surface faces toward the liquid store and has a planar abutment surface against which the sealing ring bears, and the side of the end surface has a region, the region being recessed in relation to the planar abutment surface, the at least one ventilation aperture opening into the region.

10. The liquid dispenser as claimed in claim 8, wherein the sealing ring has a planar abutment surface disposed to bear against the end surface, and the sealing ring has, on a side of the sealing ring facing toward the end surface, a region, the region being recessed in relation to the planar abutment surface and the region being arranged such that the at least one ventilation aperture opens into the region of the sealing ring.

11. The liquid dispenser as claimed in claim 1, wherein:

the discharge head has an actuating push button which is mounted slidingly on the main component;, or the discharge head has an actuating push button, the actuating push button which, together with the main component, defining an interior space, the pump device including a pump chamber arranged in the interior space.

12. The liquid dispenser as claimed in claim 1, wherein the pump device has a pump chamber formed by an elastic compressible hollow body of open form at an entrance side and at an exit side.

13. The liquid dispenser as claimed in claim 1, wherein:

the main component has a pump chamber formed from a hollow body and a pump chamber connector projecting beyond the end surface in an opposite direction from the liquid store, the pump chamber connector being attached to the hollow body; or the coupling device is formed as an internal thread; or the coupling device is designed as a detent device, the main component including at least one elastically deflectable detent edge for detent engagement on the outlet connector of the liquid store; or the discharge head has a wall surrounding the ventilation aperture, the wall having at least one surface-forming edge, portions of the wall converging on one another at the at least one surface-forming edge at an angle of at least 135° , the surface-forming edge being of sharp-edged form with a radius of curvature of <0.1 mm; or a central axis of the at least one ventilation aperture extends parallel to a main extent direction of the outlet connector of the liquid store.

14. The liquid dispenser as claimed in claim 1, wherein the discharge head includes an end wall, the end wall having an end wall portion on which the end surface is disposed, the end wall portion being oriented transversely to an actuation direction of the pump device, and the at least one ventilation aperture of the end surface extends through the end wall portion.

15. The liquid dispenser as claimed in claim 14, wherein the end wall and the coupling device are formed as a unitary, one-piece component.

16. The liquid dispenser as claimed in claim 1, wherein the at least one ventilation aperture has a central axis and the outlet connector of the liquid store is substantially cylindrical, and the central axis is substantially parallel to a central axis of the outlet connector.

17. A liquid dispenser for dispensing cosmetic or pharmaceutical liquids, said dispenser comprising:

a liquid store having an interior filled with a cosmetic or pharmaceutical liquid, said liquid store having an outlet connector with an open distal end; and a discharge head fastened to said outlet connector of said liquid store, said discharge head comprising:

a coupling device connected to said outlet connector of said liquid store;

a liquid inlet disposed adjacent to and in communication with said liquid store;

a discharge opening;

a pump device configured to convey liquid from said liquid inlet to said discharge opening;

a ventilation channel disposed to connect said interior of said liquid store to an external environment of said discharge head; and an end wall disposed adjacent said open distal end of said liquid store, said end wall and said coupling device being formed as a unitary, one-piece component, said end wall including an end wall surface disposed to substantially close off said open distal end of said outlet connector of said liquid store, said liquid inlet extending through said end surface, said end surface defining therein at least one ventilation aperture forming part of said ventilation channel, said at least one ventilation aperture being configured to permit air flow into said liquid store in an inflow direction, said at least one ventilation aperture having a cross-section, a narrowest part of said cross-section having a dimension not exceeding $3 \cdot 10^{-2}$ mm$^2$, the dimension being adapted to a surface tension of the liquid in said liquid store such that the surface tension prevents passage of the liquid through said at least one ventilation aperture under a maximum hydrostatic pressure generated by the liquid in the liquid store.

18. The liquid dispenser as claimed in claim 17, wherein said end wall is oriented transversely to a longitudinal direction of said pump device and said at least one ventilation aperture extends through said end wall.

19. The liquid dispenser as claimed in claim 18, wherein said at least one ventilation aperture has a central axis oriented substantially parallel to an actuation direction of said pump device.

* * * * *